United States Patent [19]

Hill et al.

[11] 4,205,768

[45] Jun. 3, 1980

[54] COMPETITION GUN BELT

[76] Inventors: Ernie H. Hill; Ernest H. Hill, both of 4547 N. 51st Ave., Phoenix, Ariz. 85031

[21] Appl. No.: 884,614

[22] Filed: Mar. 8, 1978

[51] Int. Cl.[2] ..... F41B 13/04

[52] U.S. Cl. ..... 224/193; 224/243; 224/912

[58] Field of Search ..... 224/2 B, 2 C, 2 A, 2 D, 224/2 R, 5 R, 5 A, 5 H, 5 V, 5 MC, 26 R, 26 C, 22, 23, 21, 17, 13, 15; 2/319, 312

[56] References Cited

U.S. PATENT DOCUMENTS

| | | | |
|---|---|---|---|
| 1,282,695 | 10/1918 | Jennings | 224/23 |
| 1,295,831 | 3/1919 | Alderson | 224/2 B |
| 1,310,377 | 7/1919 | Sisson | 224/23 |
| 2,413,580 | 12/1946 | Penny | 224/22 |
| 2,819,830 | 1/1958 | Murray | 224/2 B |
| 2,825,068 | 3/1958 | Montgomery | 224/26 R |
| 3,664,560 | 5/1972 | Perkins | 224/26 R |
| 3,804,306 | 4/1974 | Azurin | 224/2 B |
| 3,963,157 | 6/1976 | Truax et al. | 224/26 R |
| 4,079,870 | 3/1978 | Clark | 224/2 B |

*Primary Examiner*—Kenneth W. Noland
*Attorney, Agent, or Firm*—Cahill, Sutton & Thomas

[57] ABSTRACT

A gun belt for use in combat side arm competitions supports a side arm retaining boot. A fender extends from the gun belt and a depending shank to support the boot at a predetermined lateral and angular orientation with respect to the gun belt. The boot, of a composite structure bent back upon itself to define rearwardly extending skirts, is readily adjustable to vary the clamping force exertable upon the barrel of the side arm retained by the skirts. A bearing piece joins the opposed rear edges of the skirts without interfering with the integrity of the boot clamping function and provides a low friction bearing surface for rapid drawing of the side arm from the boot. Removable straps provide an option of physically locking the side arm within the boot.

14 Claims, 8 Drawing Figures

COMPETITION GUN BELT

The present invention relates to gun belts and, more particularly, to competition gun belts.

Conventional gun belts for side arms include a holster for supporting, in depending relationship, a revolver. Typically, the hand grip of the revolver is disposed at or below the horizontal plane defined by the lower edge of the gun belt when the gun belt is in place. The holster itself is typically sewn or otherwise attached directly to the gun belt. Moreover, the holster is constructed from one or two layers of leather to form a composite and the composite is folded over upon itself with the curved fold being forward and the rear edges being sewn together. The bottom tip of the holster may be open ended or close ended. A depression is often provided at the rear edge of the holster for receiving the front edge of the trigger guard; in other holsters, the trigger guard is enclosed within an appropriately shaped cavity within the holster.

In recent years, fast draw sporting events have become very popular. For these events, conventional gun belts, of the type described above, have been used or slightly modified forms thereof have been developed. However, the caliber of competition has become such that fractions of a second may mean the difference between winning or being an also ran. Accordingly, much effort has been expended to develop holsters which permit the fastest possible draw commensurate with an accurate and sure grip of the side arm.

Conventional fast draw competitions are for side arms of the revolver type. However, a new category has developed known as "combat" which involves the use of pistols of the clip-fed .45 caliber type hand guns. In "combat" competitions, a competitor must exhibit competence from each of a plurality of stationary stances and he must be able to draw, aim and fire his side arm while in motion. "Combat" competitions also require that the side arm be lodged within a supporting holster to a degree sufficient to prevent it from falling out were the holster to be turned upsidedown. This requirement is accomplished either by strapping the side arm into the holster or by having the holster clampingly retain the side arm.

Because of the multitude of positions used in combat competitions, the gun belt and side arm retaining holster must be configured to optimize the draw of the side arm from any one of many stances of the competitor. Necessarily, the requirements of one stance of the competitor are almost mutually exclusive with the requirements imposed by another stance. To develop a gun belt which optimizes the draw of the side arm at all stances, whether stationary or mobile, is extremely difficult and can be achieved only by a laborious trial and error effort.

The various requirements of a gun belt for "combat" competitions may be summarized as follows. The gun belt must be positioned upon the competitor such that the movement of the competitor is not impeded and such that the movement of the competitor will not reorient the gun belt and the supported side arm. The side arm must not extend too far down the thigh of the competitor or else drawing of the side arm becomes difficult in a crouching or seated position. If the side arm is located too high, drawing is difficult from an upright stance and may impede movement of the side arm to bring it to bear on the target. These conflicting requirements have been optimized in the embodiment described below.

To describe the present invention in the vernacular of gun belt manufacturers and competitions, the berm "boot" will be used to define the element usually termed as the holster.

It is therefore a primary object of the present invention to provide a gun belt for use in "combat" competitions.

Another object of the present invention is to provide a gun belt supporting a removable boot.

Yet another object of the present invention is to provide a gun belt for supporting a boot depending from and lateral to the gun belt.

Still another object of the present invention is to provide a shank and belt attached fender for supporting a boot.

A further object of the present invention is to provide a configuration of a "combat" competition gun belt which supports a side arm receiving boot relatively high with respect to the gun belt.

A yet further object of the present invention is to provide a maintainable but adjustable clamping force exerted by a boot upon a retained side arm.

A yet further object of the present invention is to provide a boot having three open sides for adjustably accommodating differing clamping forces exerted upon a retained side arm.

A yet further object of the present invention is to provide a bearing member within a boot for aiding ingress and egress of a side arm.

A yet further object of the present invention is to provide removable means for physically locking a side arm within a boot.

A still further object of the present invention is to provide an inexpensive removable clip case for "combat" competition gun belts.

These and other objects of the present invention will become apparent to those skilled in the art as the description thereof proceeds.

The present invention may be described with greater specificity and clarity with reference to the drawings, in which.

Figure 1:
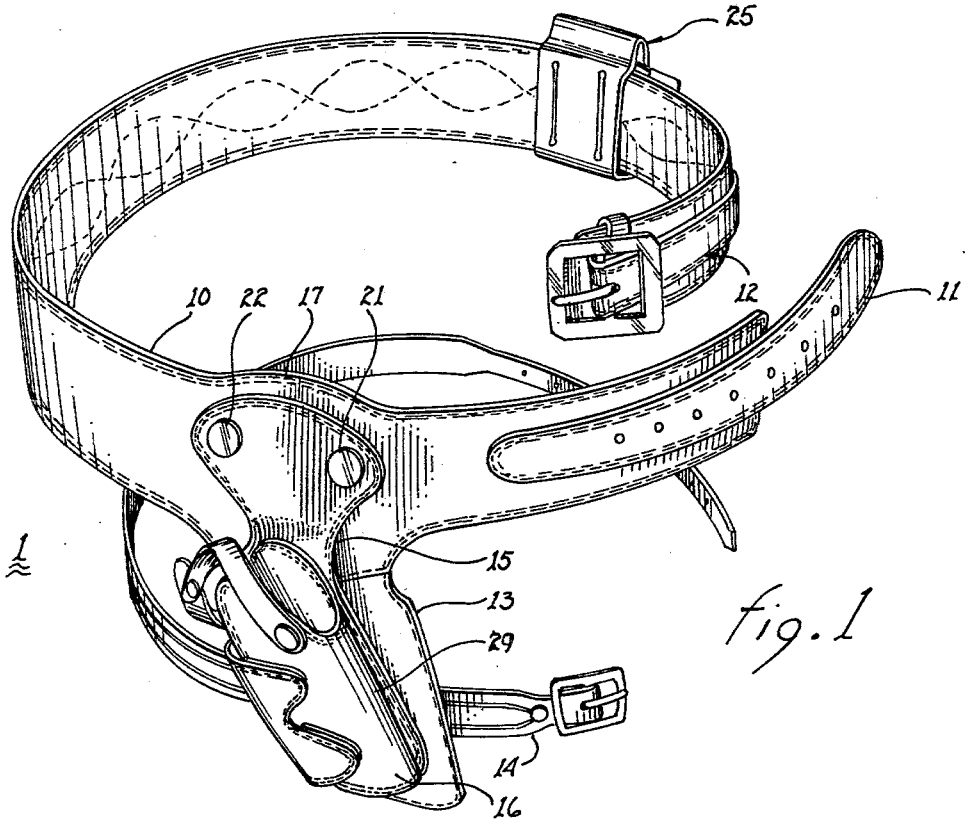
FIG. 1 is a perspective view of a "combat" competition gun belt.

Referring to FIG. 1, there is illustrated a competition gun belt 1 for supporting a competition side arm. The configuration of the gun belt is specifically directed to the requirements attendant "combat" competitions wherein an automatic pistol, such as a .45 caliber clip-fed automatic pistol, is drawn, aimed and fired at a predetermined target from any of several stances. Because of the rules attendant such competitions and in view of the configuration and characteristics of automatic pistols, special criteria must be satisfied in order to facilitate the drawing, aiming and firing of the pistol and render the competitor competitive.

To meet the needs of "combat" competitions, the pistol must ride high relative to the belt, as compared to conventional "fast draw" competitions. The boot for the pistol must be capable of retaining the pistol sufficiently securely to prevent the pistol from inadvertently falling out; this goal is accomplished by adjustably clamping the barrel of the pistol and/or by physically retaining the pistol with a strap. As the pistol must be rapidly drawn from the boot, a low friction bearing surface is provided to preclude binding on withdrawal and to provide a bearing surface against which the pistol barrel rides during withdrawal. When the holstered pistol rests essentially adjacent a competitor's hip, the orientation of the pistol is not at its most optimum position for rapid draw; accordingly, a particularly configured fender extends laterally outwardly from the supporting belt and shank to place the pistol at the most accessible location for rapid drawing.

As the pistols used in "combat" competitions are clip-fed, a clip case is generally worn to house loaded clips. During one aspect of the competitions, the pistol must be reloaded with a new clip. Therefore, the clip case has been configured to provide rapid and sure retrieval of the clip, which act of retrieval places the clip properly oriented in the competitor's hand for insertion into the pistol with minimal fumbling.

Figure 2:
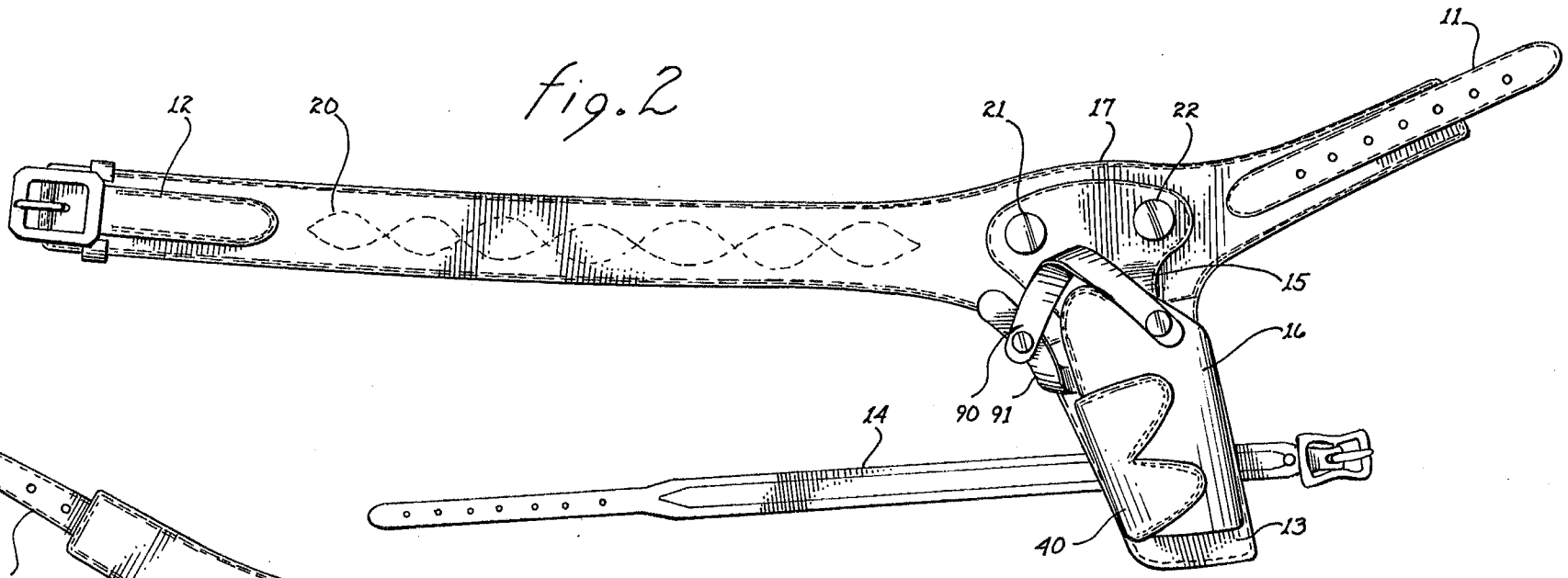
FIG. 2 is a plan view of the exterior of a "combat" competition gun belt.

The elements of the present invention which, in combination, result in a gun belt having the above enumerated features will be described in general terms with reference to FIGS. 1, 2 and 3. The body of gun belt 10 is relatively wide, on the order of 2½ to 3 inches, to fit about the competitor firmly and provide sufficient support for the retained pistol. A strap 11 and buckle 12, which may be of conventional design, secure the belt about the competitor. A shank 13, extending downwardly from belt 10, may be secured to the thigh of the competitor through an attached strap and buckle 14. A fender 15, supporting boot 16, is attached to and extends intermediate belt 10 and the lower part of shank 13. As noted, the upper edge of belt 10 in proximity to the attachment point of fender 15 has an upwardly extending hump 17. The purpose of this hump is to allow a relatively high attachment point for the upper part of the fender and yet retain sufficient belt material intermediate the attachment points and the edge of the belt to provide firm support.

Figure 4:
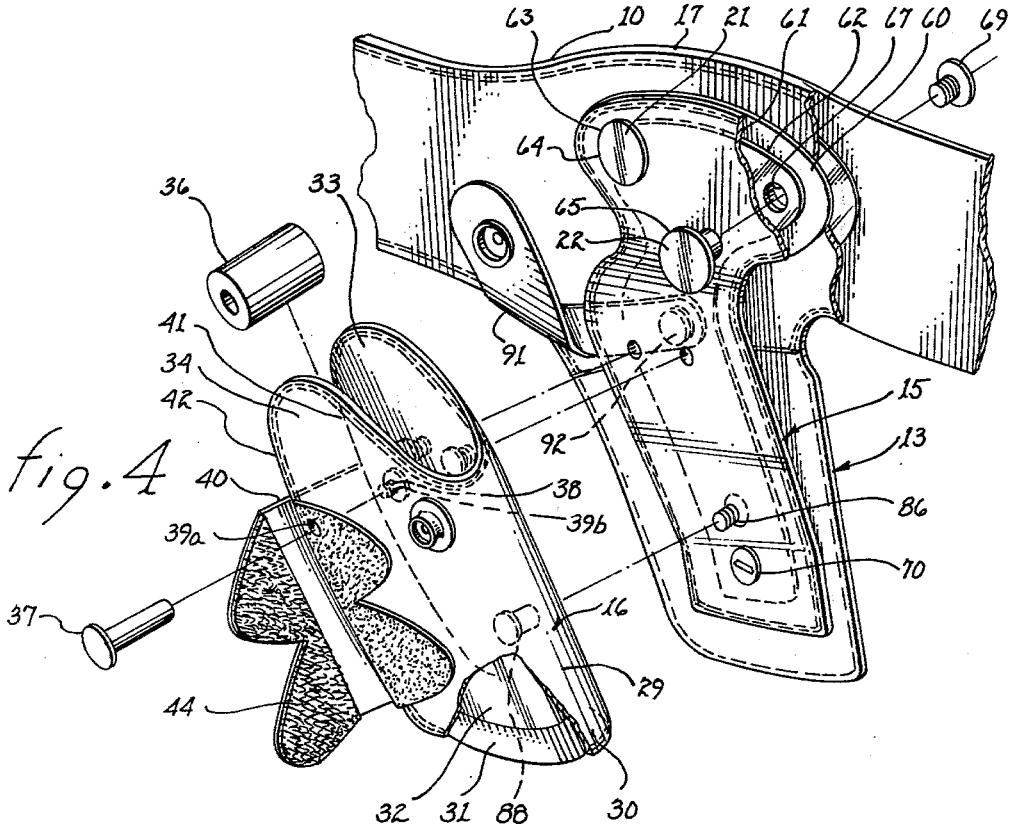
FIG. 4 is an exploded view of a side arm retaining boot for a "combat" competition gun belt.
Figure 3:
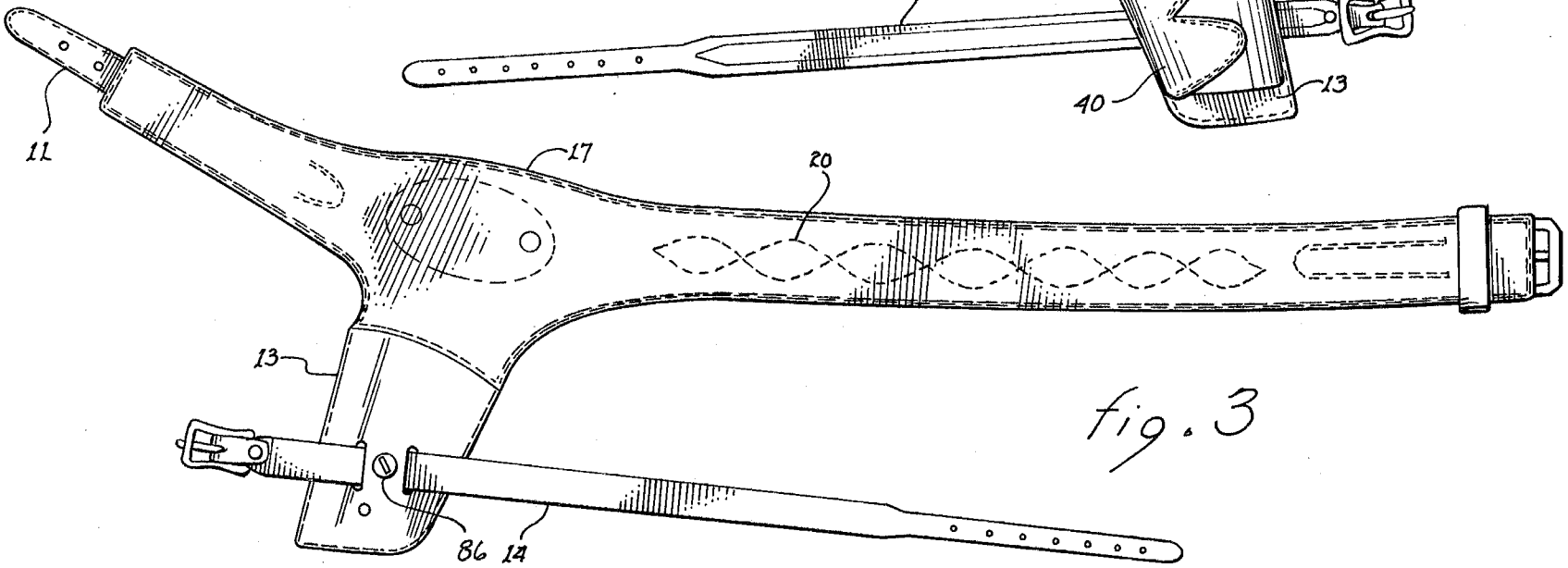
FIG. 3 is a plan view of the interior surface of a "combat" competition gun belt.
Figure 5:
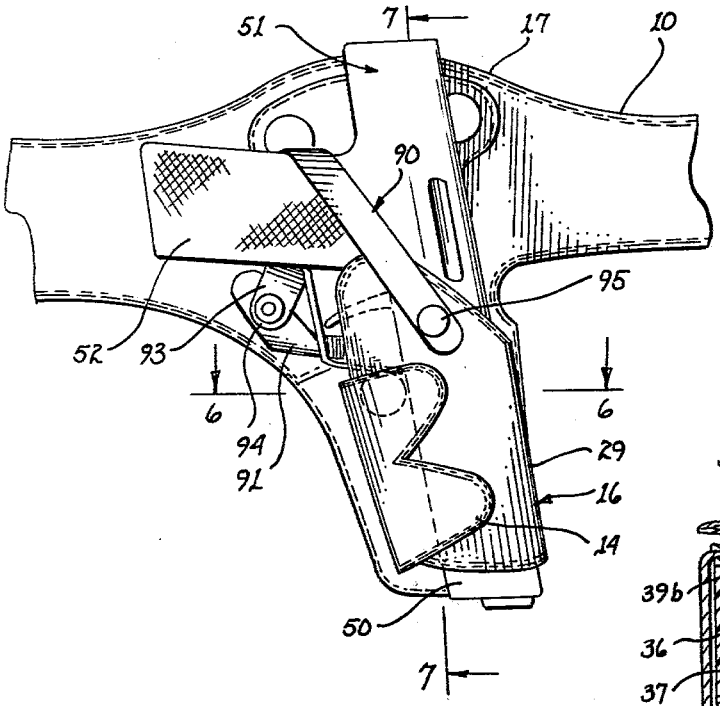
FIG. 5 illustrates a side arm inserted within a boot.
Figure 6:
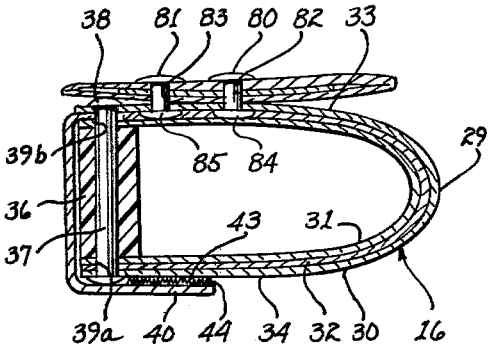
FIG. 6 is a cross-sectional view taken along lines 6—6, as shown in FIG. 5.

As illustrated particularly in FIGS. 3 and 4, belt 10 may include decorative leather work 20. Additionally, attachment means 21 and 22 for fender 15 may be configured as not only functional but as decorative elements.

A clip case 25 is removably mounted upon gun belt 10 through penetrable engagement thereof by the gun belt.

The configuration of and support for boot 16 will be described with particular reference to FIGS. 4, 5, 6 and 7. Boot 16 is developed as a composite structure from two layers of leather, 30, 31, which envelope a metallic insert 32. The composite structure is folded or bent upon itself along bend 29 to define skirts 33 and 34. The insert is formed from bendable but flexibly resilient sheet metal; thereby, the folded structure maintains the form of the boot and provides a clamping action to the barrel of a pistol inserted within the boot. Moveover, the nature of the metallic insert allows adjustment of the boot to accommodate different degrees of clamping force. As noted in the drawings, skirts 33, 34 have no permanent interconnection, except at bend 29 and at the support provided by a bearing piece 36.

To preclude splaying of skirts 33 and 34 due to continued insertion and withdrawal of the pistol, a flap 40 extends from rear edge 41 of skirt 33, around edge 42 of skirt 34 for attachment to the lateral side of skirt 34. To accommodate infinite positioning of the end of flap 40 adjacent the surface of skirt 34, the attachment means must be capable of securing engagement therebetween at any point within a predeterminable range. An attachment means particularly suited for this purpose is that of a mating set of fabric backed hook retainer 43 and loop retainer 44, commonly sold under the registered trademark "Velcro". Thereby, the relative positioning between skirts 33 and 34 will be maintained by flap 40 engaging skirt 34. To increase or decrease the clamping force exerted by skirts 33 and 34, the flap is readily disengaged from skirt 34 and readjusted to maintain the skirts more or less closer to one another. It may be noted that the portions of edges 41 and 42 engaged by the flap extend downwardly from bearing piece 36.

Bearing piece 36 is disposed intermediate edges 41 and 42 of skirts 33 and 34 by an internally threaded stud 37 threadedly engaging an externally threaded stud 38 extending through apertures **39*a* and 39*b*, respectively. The bearing piece serves three functions. First, it bears against the lower edge of barrel 50 of pistol 51 (see FIG. 5) to prevent rearward pivotal movement of the barrel within boot 16. Secondly, the bearing piece is made of a low friction plastic, such as the type sold under the registered trademark "Teflon". The resulting low friction characteristics of the bearing piece precludes binding of the barrel as the pistol is withdrawn from the boot and simultaneously serves as a low friction bearing surface for the lower edge of the barrel during both upward and rearward pivotal movement of the pistol. Third, the bearing piece, cooperating in conjunction with metallic insert 32, maintains the upper end of boot 16 sufficiently wide to receive the breech portion of pistol 51 without exerting a clamping force thereon. Thereby, a decrease/increase in the splayed relationship between skirts 33 and 34 at the lower end of the boot to increase/decrease the clamping force exerted upon barrel 51** will not produce a commensurate clamping force upon the breech of the pistol.

With the above described construction of boot 16, the requirement in "combat" competitions of having a boot retain a pistol when the boot is turned upsidedown is readily met by simply adjusting the degree of splaying between skirts 33 and 34.

As is self evident, boot 16 is readily adaptable to different pistols and size variations of the barrels thereof.

Conventional holsters are normally formed as part of or permanently attached directly to the belt and shank. Such attachment is not preferred for "combat" competitions as the pistols employed and the various stances attendant such competitions render it more difficult to draw, aim and fire the pistol. Additionally, the holster is not readily replaceable. Furthermore, holsters of this type are normally sized and configured to receive a particular type of side arm. Were the owner to wish to use the same gun belt with a different side arm, he would be precluded from doing so without substantial expense in replacing the holster; consequently, a different gun belt and holster combination would have to be purchased for each distinct side arm to be worn.

Figure 7:
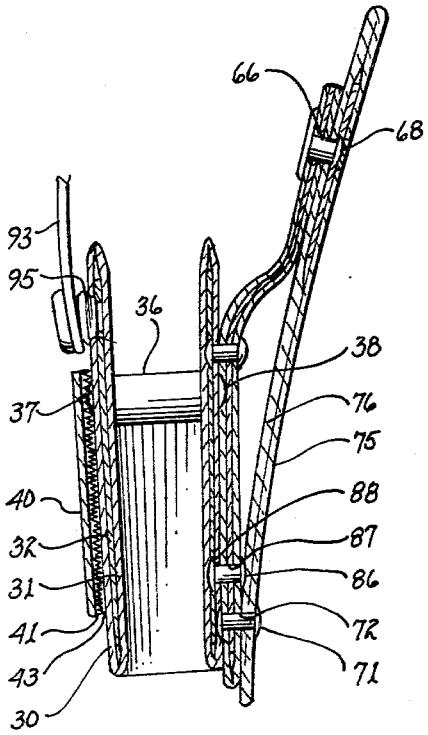
FIG. 7 is a cross-sectional view taken along lines 7—7, as shown in FIG. 5.

To avoid the above noted constrictions and restrictions attendant conventional gun belts, the boot is not attached directly to the gun belt and shank. Instead, a fender extends from the gun belt downwardly to the lower end of the shank and supports boot 16 lateral to the gun belt and at an essentially vertical orientation, as illustrated in FIG. 7.

The upper end of fender 15 includes an enlarged section 63 to provide substantial spacing intermediate attachment means 21 and 22 whereby rotational movement of the fender about a vertical axis is essentially totally impeded. Attachment means 21 and 22 include a pair of internally threaded studs 64 and 65 penetrating apertures 66 and 67 extending through the corresponding parts of fender 15 and belt 10. Retaining externally threaded studs 68 and 69, which may be partly countersunk within gun belt 10, secure studs 66 and 67. The lower end of the fender is secured to the lower end of the shank by an internally threaded stud 70 mating with an externally threaded stud 71 inserted through an aperture 72 and extending through both the fender and the shank. From the above description, it will become apparent that fender 15 is readily replaceable, if damaged, or for other reasons, by simply unthreading the three attachment means.

In the position illustrated for the fender supported boot, the pistol is supported sufficiently far from the competitor's body to allow hand movement unimpeded by the body when reaching for and drawing the pistol from the boot. The vertical orientation of the supported pistol also tends to maintain the plane of the pistol (the plane defined by the axis of the barrel and the handle) vertical during drawing, aiming and firing without requiring lost motion or reorientation of the pistol with respect to the vertical plane.

Fender 15 is constructed as a composite unit from two layers of leather 60 and 61 enveloping a formed metallic insert 62. The composite unit is bent into the configuration illustrated and the configuration is maintained by the metallic insert. By this configuration, the upper part of attached boot 16 is displaced lateral to the corresponding part of shank 13 and the lower end of the boot is essentially adjacent the lower end of the shank (see FIG. 7).

Shank 13 is preferably developed from a pair of sections of leather 75 and 76 which are cured to be relatively stiff. Thereby, shank 13 is stiff and provides a firm foundation in combination with the gun belt to support the fender.

Boot 16 is secured to the essentially vertical surface of fender 15 by a pair of upper internally threaded studs 80 and 81 extending through apertures 82 and 83 to mate with externally threaded studs 84 and 85, which studs have their heads fixedly attached to metallic insert 32. A lower externally threaded stud 86 extends through aperture 87 to internally threaded stud 88, the head of which is fixedly attached to metallic insert 32. Since the heads of studs 84, 85 and 88 do not penetrate the interior of boot 16, these heads will not scratch or impede movement of the pistol into and out of the boot. Again, as may be noted from the drawings, the boot is readily detachable from the fender by unthreading the respective studs.

Pistol 51 may be secured within boot 16 by locking strap 90. The strap includes a first strap 91 having one end attached to the interior surface of fender 15 by a snap 92. The other end of strap 91 is attached to a second strap 93 by snap 94. Strap 93 extends about handle 52 to engage snap 95 disposed on skirt 34 of boot 16. Through the use of these snaps, either or both straps 91 and 93 may be removed during competitions. In the alternative, the competitor may elect not to use the clamping force exertable by boot 16 to retain pistol 51 in the boot and he may instead elect to use strap 90 as the means for retaining the pistol in the boot. The use of snaps to retain the straps in place permits the competitor to employ a fanning motion of the hand to effect quick disengagement of the straps while simultaneously reaching for and drawing the pistol.

Figure 8:
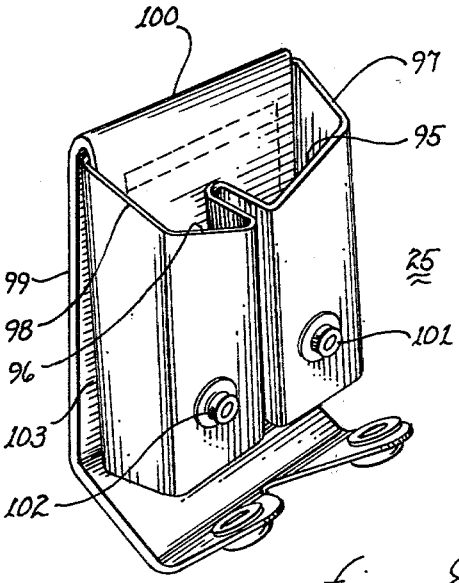
FIG. 8 is a perspective view illustrating a demountable clip case.

As some events in "combat" competitions require the reloading of the pistol by insertion of a loaded clip, it is necessary that such clips be readily available to the competitor. Clip case 25, as particularly illustrated in FIG. 8, was constructed to serve such a need of the competitor.

The clip case includes two compartments, 95, 96, each of which retains a loaded clip. Edges 97 and 98 of these compartments slope downwardly and centrally to the junction between the two compartments. With an opening of this configuration, a sufficient length of the butt end of the clip extends above the upper edge of the compartment to allow the competitor to readily grasp a clip. Additionally, the sloping edge accommodates pivotal movement of the clip during withdrawal thereof to reorient the clip for rapid insertion into the pistol.

Preferably, clip case 25 is mounted directly upon gun belt 10 at a position where the contained clips can be readily grasped. The mounting means for the clip case includes a flap 99 depending from upper rear edge 100 and extending across the open bottom with the end thereof being placed adjacent the front surface of the case and retained in place by snaps 101 and 102. Thereby, an open ended envelope 103 is developed intermediate flap 99 and the rear surface of the clip case for penetrably receiving the gun belt. Since the preferred height of gun belt 10 is essentially commensurate with the length of most clips used for the pistols employed, envelope 103 is essentially equivalent in height to the width of the gun belt. Thus, by serendipity, there exists little freedom of the clip case to travel upwardly or downwardly with respect to the gun belt upon which it is mounted. The use of snaps 101 and 102 facilitates engagement and disengagement of the case. In an alternate embodiment, the rear surface of clip case 25 may be sloted to receive gun belt 10 but the attendant threading of the clip case onto and off of the gun belt may be somewhat awkward or cumbersome.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. A competition gun belt assembly for supporting a side arm and having a gun belt supported shank, said assembly comprising in combination:

a. a boot for retaining the side arm, said boot comprising a multi-layered structure bent along a forward bend line and defining two displaced skirts for exerting a clamping force upon the side arm inserted within said boot, said skirts being displaced from each other and extending rearwardly from the bend line, said multi-layered structure including an insert for maintaining said skirts in a generally coincident but displaced relationship;

b. means for adjustably limiting the displacement intermediate the rear edges of said skirts and regulating the clamping force exerted by said skirts;

c. a fender comprising a multi-layered composite for suspending said boot in fixed relationship to the gun belt, said fender including an upper end secured to the gun belt, a lower end secured to the shank and a bent center section laterally displaced from the belt and the shank being attachably connected to said boot, said multi-layered composite including an insert for maintaining the bent shape of said center section; and d. a bearing piece disposed intermediate the rear edges of said pair of skirts for supporting the trigger guard of the side arm when the side arm is retained within said boot and allowing for guiding of the barrel of the side arm during withdrawal of the side arm from said boot.

2. The assembly as set forth in claim 1 wherein said bearing piece is of low friction material.

3. The assembly as set forth in claim 1 wherein said limiting and regulating means comprises a flap extending from one of said skirts across the rear edges of both of said skirts to the other of said skirts and includes infinitely adjustable attachment means for attaching said flap to said other skirt.

4. The assembly as set forth in claim 3 wherein top, rear and bottom edges of one of said skirts are displaced from commensurate top, rear and bottom edges of the other of said skirts.

5. A competition gun belt assembly for supporting a side arm and having a gun belt supported shank, said assembly comprising in combination:

a. a boot for retaining the side arm, said boot comprising a multi-layered structure bent along a forward bend line and defining two displaced skirts for exerting a clamping force upon the side arm inserted within said boot, said skirts being displaced from each other and extending rearwardly from the bend line;

b. means for adjustably limiting the displacement intermediate the rear edges of said skirts and regulating the clamping force exerted by said skirts;

c. a fender for suspending said boot in fixed relationship to the gun belt, said fender including an upper end secured to the gun belt, a lower end secured to the shank and a bent center section laterally displaced from the belt and the shank being attachably connected to said boot; and d. a bearing piece disposed intermediate the rear edges of said pair of skirts for supporting the trigger guard of the side arm when the side arm is retained within said boot and allowing for guiding of the barrel of the side arm during withdrawal of the side arm from said boot.

6. The assembly as set forth in claim 5 wherein said bearing piece is of low friction material.

7. A boot mountable upon a gun belt for retaining a side arm, said boot comprising in combination:

a. a composite structure folded upon itself along a forward bend line to define two skirts, each of said two skirts having a top edge, a rear edge and a bottom edge displaced from and unconnected to the corresponding top, rear and bottom edges of the other skirt;

b. a bearing piece attached intermediate said skirts in proximity to the rear edges of said skirts for supporting the trigger guard of the side arm during withdrawal of the side arm;

c. resilient means disposed within said composite structure for exerting a clamping force upon the barrel of the side arm inserted intermediate said skirts;

d. means for adjustably limiting the maximum displacement intermediate the rear edges of said skirts to regulate the clamping force exerted by said resilient means; and e. means for attaching said boot to the gun belt.

8. The boot as set forth in claim 7 wherein said resilient means comprises a sheet of resilient metal.

9. The boot as set forth in claim 8 wherein said sheet of metal is of a planform equivalent to the planform of said composite structure but of a reduced size.

10. The boot as set forth in claim 9 wherein said composite structure includes two layers of leather for enveloping said sheet of metal therebetween.

11. The boot as set forth in claim 10 including removable strap means for locking the side arm within said boot.

12. The boot as set forth in claim 10 wherein said bearing piece is of low friction material.

13. The boot as set forth in claim 10 wherein said limiting and regulating means comprises a flap extending from one of said skirts across the rear edges of both of said skirts to the other of said skirts and includes infinitely adjustable attachment means for attaching said flap to said other skirt.

14. The boot as set forth in claim 10 wherein said attaching means comprises a fender secured to the gun belt, said fender defining an attachment point for said boot lateral to the gun belt.

* * * * *